US005913272A

United States Patent [19]

Gutgsell et al.

[11] Patent Number: 5,913,272

[45] Date of Patent: Jun. 22, 1999

[54] FOLDING TABLE RELEASE LATCH APPARATUS

[75] Inventors: David R. Gutgsell; Scott Schwinghammer, both of Jasper, Ind.

[73] Assignee: Ditto Sales, Inc., Jasper, Ind.

[21] Appl. No.: 09/100,654

[22] Filed: Jun. 19, 1998

[51] Int. Cl.[6] ..... A47B 3/00

[52] U.S. Cl. ..... 108/132; 248/439

[58] Field of Search ..... 108/133, 132, 108/131, 129; 248/188.6, 188.1, 166, 440, 439

[56] References Cited

U.S. PATENT DOCUMENTS

| | | | |
|---|---|---|---|
| 3,554,141 | 1/1971 | Burr | 108/132 |
| 3,769,920 | 11/1973 | Weiss | 108/133 |
| 4,561,622 | 12/1985 | Heinzel . | |
| 4,573,415 | 3/1986 | Ramey | 108/132 X |
| 4,838,180 | 6/1989 | Gutgsell . | |
| 5,390,610 | 2/1995 | Gutgsell . | |
| 5,606,922 | 3/1997 | Adams et al. | 108/129 |
| 5,636,578 | 6/1997 | Rizzi | 108/132 X |
| 5,638,761 | 6/1997 | Berkowitz et al. | 108/132 |

*Primary Examiner*—Jose V. Chen
*Attorney, Agent, or Firm*—Beck, Michael & Beck, P.C.

[57] ABSTRACT

A folding leg apparatus is provided to mount a leg to an article of furniture, such as a tabletop, so that the leg can be moved between extended and retracted positions. The table leg has a pair of upright bars disposed apart from each other. the apparatus includes a pair of support brackets mounted to the underside of the tabletop and straddling the upright bars of the leg. A pair of swivel brackets and a pair of brace links are pivotably mounted at opposite ends of each support bracket. A pair of pivot rods are attached to the upright bars adjacent the free end of the leg, and the swivel brackets and brace links are pivotably connected to a corresponding pivot rod. The apparatus includes a latch and release mechanism that includes a release lever having an actuator plate positioned within the envelope of the support brackets. The release lever includes a pair of lever arms that each define a locking notch for receiving one of the pivot rods therein to lock the leg in its upright position. The latch release mechanism further includes a torsion spring operatively connected between the release lever and the support brackets to bias the release lever to a position in which the locking notch captures the pivot rod.

15 Claims, 5 Drawing Sheets

FOLDING TABLE RELEASE LATCH APPARATUS

BACKGROUND OF THE INVENTION

The present invention pertains generally to folding furniture and, more specifically to tables having legs that fold compactly underneath the tabletop. In particular, the invention concerns an folding apparatus for extending and retracting the legs and a latch mechanism for locking the legs in position.

Folding tables are widely used and derive their primary benefit from the relative ease with which they can be handled and stored when in the folded condition. One typical folding table leg is described in the patent to Weagle, U.S. Pat. No. 3,695,567. Folding tables of this type do not include a cross brace that provides fore and aft support for the table leg. Another difficulty with folding table designs such as the configuration shown in the weagle patent is that the folded legs do not provide a uniform surface on which other folded tables may be stacked because the legs overlap each other.

An alternative design is a trestle-type table, such as the folding table shown in the patents to Burr, U.S. Pat. Nos. 3,818,844 and 4,444,124. In these tables, the vertical legs do not overlap each other; however, like the weagle device, the folded legs themselves provide the stacking surface for other folded tables. An additional difficulty associated with trestle-type tables is that they are often difficult to fold and handle once folded.

In U.S. Pat. No. 4,838,180, owned by the assignee of this invention, the present inventor sought to overcome many of the disadvantages of prior folding tables. This '180 patent describes a folding table that allows the table legs to be compactly folded underneath the tabletop, while still providing a uniform surface on which other tables may be stacked. One benefit of the folding table leg apparatus shown in the '180 patent is that the stacked tables are not supported on the folded legs, but rather on upright flanges forming part of the folding leg apparatus.

Certain details of the folding table leg apparatus of the '180 patent are depicted in FIG. 1. As shown in this figure, the folding leg apparatus 10 includes a top plate 11 that is mounted to the underside of a tabletop. The top plate 11 includes opposite side flanges 12 that project perpendicularly outward from the top plate 11. Rubber pads 14 are mounted at the edges of the side flanges 12 to provide a scratch resistant surface upon which a tabletop may be supported.

The folding leg apparatus 10 of this prior device includes a single tubular vertical leg 15. As shown in more detail in the '180 patent, the vertical leg 15 terminates in a base or foot that is configured to support the table on the floor. A pair of support brackets 20 are each mounted to the top plate 11 at opposite sides of the vertical leg 15. The support brackets provide an attachment or pivot point for a pair of brace links 25. The brace links 25 are pivotally connected at one end to the support bracket 20 and at the other end to the vertical leg 15 by way of a lower pivot rod 28 that passes through the tubular leg. The vertical leg 15 is also supported by an upper pivot rod 35 that spans substantially across the width of the top plate 11. The upper pivot rod 28 is pivotally connected to the side flanges 12 by way of opposite swivel brackets 47. Thus, the brace links 25 and swivel brackets 47 provide a mechanical linkage for controlled movement of the vertical leg 15 between its folded and its extended positions.

In a further aspect of this prior apparatus, a pair of release brackets 40 are provided for positively locking the upper pivot rod 35 in place when the vertical leg 15 is in its extended position. Each of the release brackets includes a lever arm 41 and an actuator plate that is manually depressed to release the upper pivot rod. A torsion spring 44 provides a positive torque to each lever arm 41 to keep it in its locked position when the release brackets 40 are engaged to the upper pivot rod. In this manner, the folding leg apparatus 10 of the '180 patent provides a positive locking mechanism to hold the vertical leg in its extended position. Likewise, the release brackets 40 provide an easy way to release the upper pivot rod so that the vertical leg can be rotated and pivoted to its stowed position. Greater detail concerning the folding leg apparatus 10 of this prior device can be found in the specification of the '180 patent, which description is incorporated herein by reference.

While the folding leg apparatus 10 of the '180 patent represents a significant improvement over prior folding leg apparatus, certain difficulties still remain. One particular problem is that the release brackets 40 are oriented so that they can be accidentally actuated under the table. For example, a person sitting at a conference table could accidentally contact one or both of the release brackets with their leg.

Another difficulty is that the direction of movement of the table leg when the release brackets are actuated can create the risk that the operator's fingers will get pinched in the folding mechanism. There is therefore a need for improvements to these various folding table leg apparatus that retains beneficial features that allow the apparatus to be easily folded and readily stowed. The need encompasses providing a folding table leg apparatus that stows the leg in such a manner as to permit stacking of folded tables.

Moreover, none of the prior folding leg apparatus is readily adapted to dual upright legs. The device in the '180 patent accommodates a single post leg. An additional detriment of some prior devices is that they require manipulation of two release levers to actuate the folding mechanism. While this detriment is of little concern for a single post leg, it is compounded with a dual upright leg that spans a width that is too difficult for the operator to manipulate.

SUMMARY OF THE INVENTION

These difficulties with prior folding leg apparatus is addressed by the apparatus and latch apparatus of the present invention. The invention has particular applicability to folding tables in which the table legs include at least two upright bars disposed apart from each other. In the preferred embodiment, the apparatus includes a pair of support brackets having means for mounting the brackets to the top of the article of furniture, or tabletop, such that said support brackets straddle the upright bars of the leg. Each of the brackets defines an elongated upstanding flange having a first end and an opposite second end. An upper pivot rod and a lower pivot rod are affixed to the upright bars adjacent the top end of the bars, with the upper pivot rod located closest to the top end.

In a further aspect of the invention, a pair of swivel brackets are each pivotably connected at one end thereof to a corresponding end of the upper pivot rod. The swivel brackets are further pivotably connected at an opposite end thereof to the first end of the flange of a corresponding one of the support brackets. The apparatus further includes a pair of brace links, each pivotably connected at one end thereof to a corresponding end of the lower pivot rod and at an opposite end thereof to the second end of the flange of a corresponding one of the support brackets.

A latch release mechanism includes a release lever defined by an elongated actuator plate substantially spanning between the flanges of each of the support brackets. The release lever also includes a pair of lever arms integral with the opposite ends of the actuator plate. Each of the lever arms defines a locking notch configured to capture the upper pivot rod therein. In one important feature of the invention, the mechanism includes means for pivotably mounting the release lever to the flange of each of said support brackets with the actuator plate disposed between said second end of the flange and the means for pivotably mounting. The means for pivotably mounting is configured so that the release lever is pivotable between a first position in which the locking notch captures the upper pivot rod and a second position in which the locking notch is separated from the upper pivot rod. In the most preferred embodiment, the means includes a torsion spring operatively anchored to the flange to bias said release lever to the first position. Torque from the spring is conveyed to the release lever through a bolt that is rotatably mounted through the flange and non-rotatably connected to the lever arms of the release lever. In a preferred embodiment, the bolt includes a keyed stem that fits within a keyed bore defined in the lever arms. The release lever is movable to the second position by depressing the actuator plate toward the support bracket or tabletop.

In further aspects of the invention, the lever arms of the release lever each define a guide channel opening to the locking notch that is positioned to guide the upper pivot rod out of the locking notch when the release lever is pivoted to the second position. The lever arms also define a foot portion opposite the locking notch that has a foot edge for contacting the support brackets when the release lever pivots in the direction from the first position to the second position. With this feature, the release lever is maintained in a readily accessible position when the table leg is in its folded position.

In certain embodiments, the table leg is maintained in its upright position simply by the linkage formed by the swivel brackets and the brace links, as maintained by the lever arms of the latch release mechanism. In other embodiments, the upper pivot rod is held against an edge of the flanges, and more particularly in recesses defined in the edges of the flanges.

It is one object to provide a folding mechanism for a folding table leg that is easy to manipulate without risk of injury to the operator. Another object is to provide a readily releasable latch that positively holds the table leg in its upright or extended position.

A further object of the invention is realized by features that allow the folding leg apparatus to maintain a low profile next to the underside of the tabletop. These features then allow the folding tables to be stacked on top of each other without risk of damage to the folding apparatus or latch mechanism.

Other object and particular benefits of the invention can be ascertained from the following written description of the invention together with the referenced figures.

DESCRIPTION OF THE PREFERRED EMBODIMENT

Figure 1:
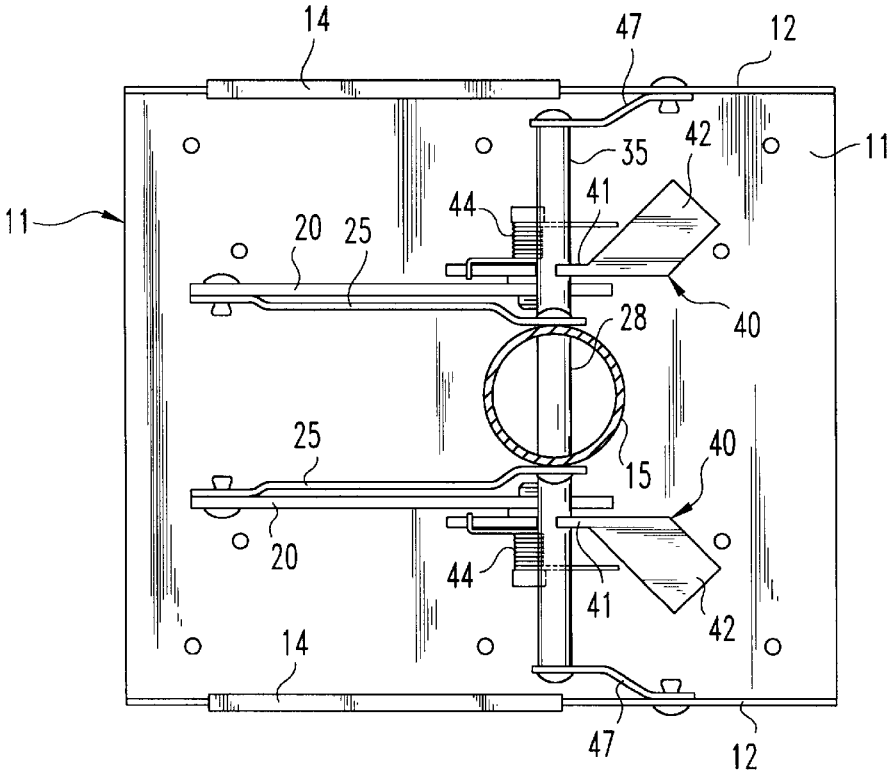
Fig. 1 (PRIOR ART)
FIG. 1 is a top elevational view of a folding table leg apparatus as described U.S. Pat. No. 4,838,180.

For the purposes of promoting an understanding of the principles of the invention, reference will now be made to one preferred embodiment illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

Figure 2:
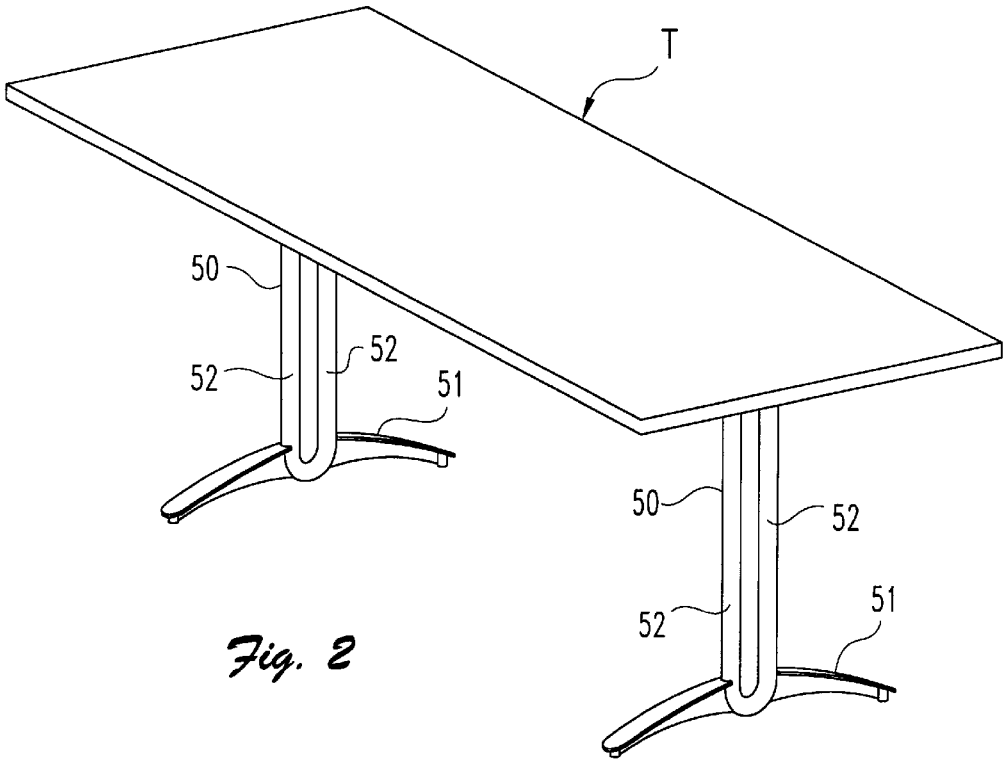
FIG. 2 is a perspective view of a folding table that utilizes a double upright bar vertical leg.

A folding table is depicted in FIG. 2 that is useable with the folding leg apparatus of the present invention. In particular, the tabletop T is supported by a pair of legs 50. Each of the legs 50 includes double-upright bars 52 connected to a foot 51 that is supported on the floor. In accordance with the present invention, each of the legs 50 can be folded underneath the tabletop T using the folding leg apparatus of the preferred embodiment.

Figure 3:
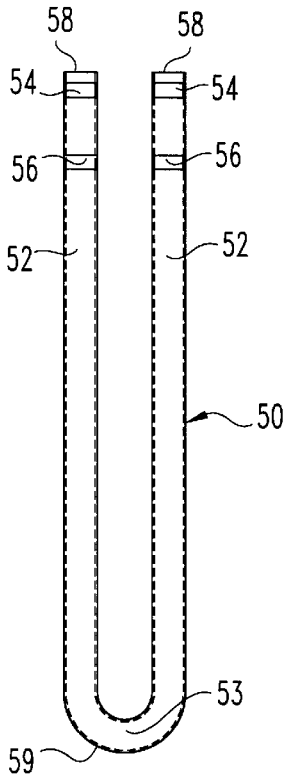
FIG. 3 is a side elevational view of a table leg of the table shown in FIG. 2.
Figure 4:
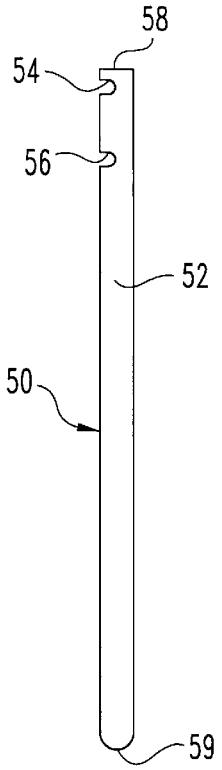
FIG. 4 is an end elevational view of the table leg shown in FIG. 3.

In this preferred embodiment, each of the table legs has a configuration shown in FIGS. 3 and 4. In particular, the legs 50 include two upright bars 52 that are connected at a bend 53 at the foot end 59 of the leg. The opposite free end 58 is disposed adjacent to the tabletop T when the leg 50 is supported by the folding leg apparatus of the present invention. Each of the upright bars 52 includes an upper notch 54 and a lower notch 56 adjacent the free end 58. As can be seen from FIG. 3, the notches 54, 56 in the opposite upright bars 52 are aligned or collinear. The upper and lower notches 54 and 56 are used to engage the table leg 50 to the folding leg apparatus of the present invention.

Figure 5:
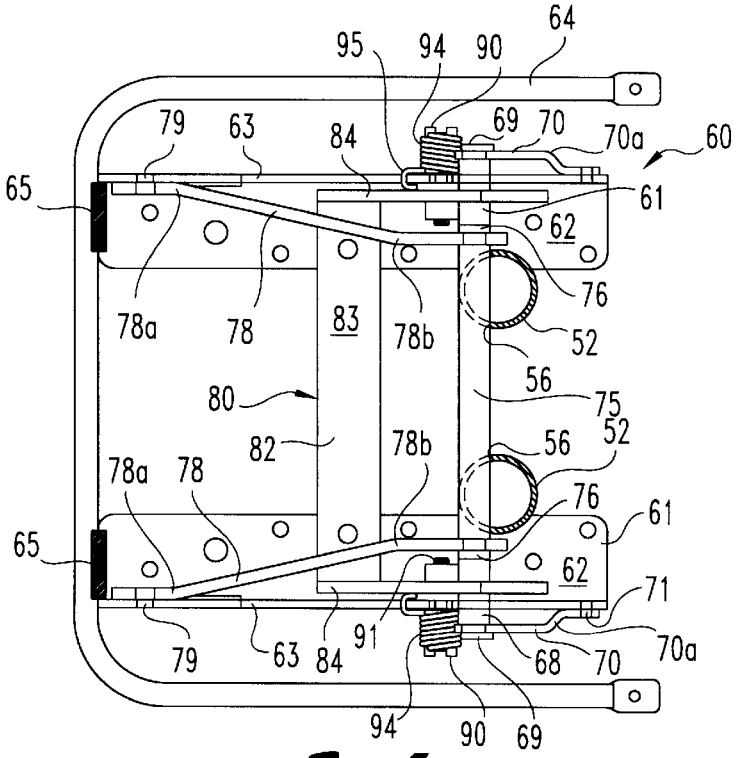
FIG. 5 is a top elevational view of a folding leg apparatus according to the present invention.
Figure 6:
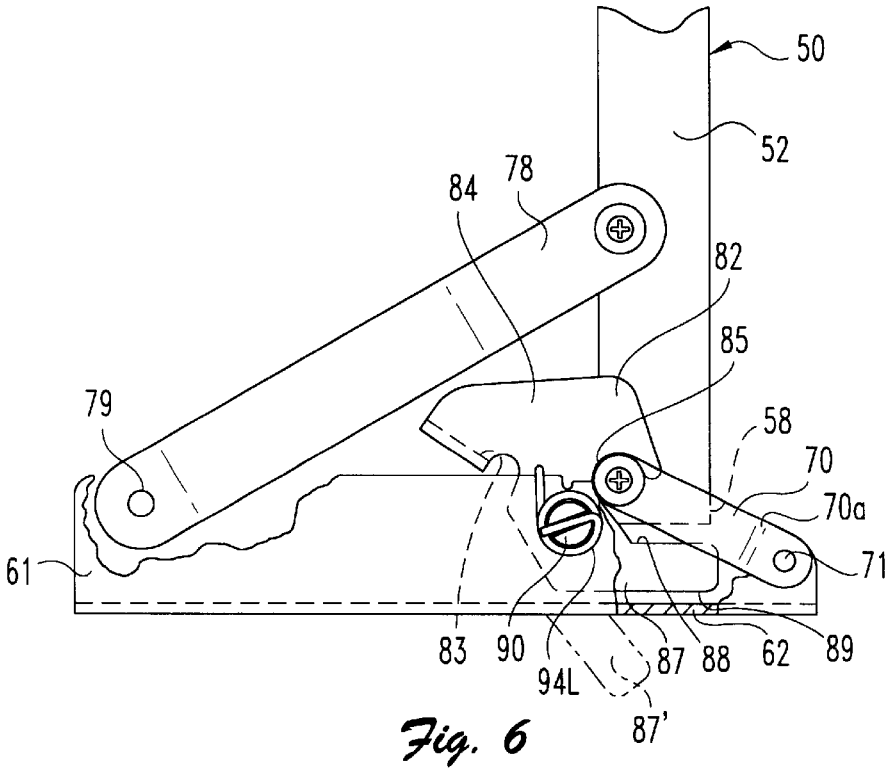
FIG. 6 is a side elevational partial cutaway view of the folding leg apparatus shown in FIG. 5.
Figure 7:
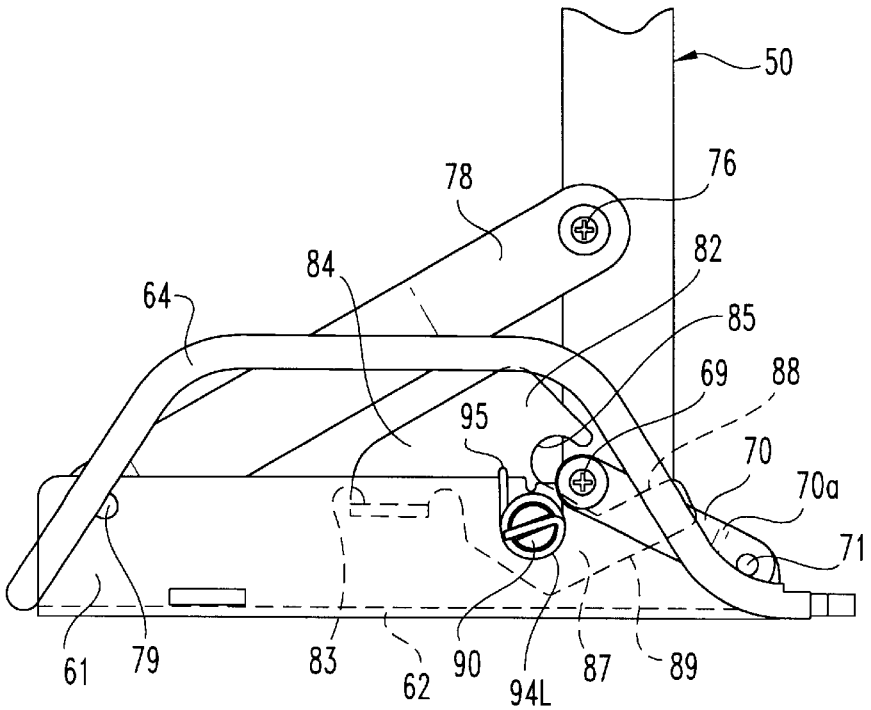
FIG. 7 is a side elevational view of the folding leg apparatus shown in FIG. 5.

Details of the folding leg apparatus 60 of the invention are shown in FIGS. 5–7. Particularly, the apparatus 60 includes a pair of opposite support brackets 61. Each of the support brackets is defined by a mounting plate 62 and an integral mounting flange 63. Preferably, the mounting flange 63 and mounting plate 62 are perpendicular to each other. Each of the mounting plates 62 includes a number of openings to receive a fastener for engaging the folding leg apparatus 60 to the underside of the tabletop T.

In one aspect of the preferred embodiment, the folding leg apparatus 60 includes a lifting handle 64 that is welded at locations 65 to each of the support brackets 61. In the preferred embodiment, the lifting handle 64 is provided for two purposes: first, to provide a hand hold to lift the table with the legs in their folded position; and second, to provide a surface for supporting the weight of another folded table stacked on top of the particular table to which the folding leg apparatus 60 is attached. The lifting handle 64 can be configured according to the carrying handle disclosed in U.S. Pat. No. 5,390,610 by the present inventor and owned by the assignee of this invention. Details of that carrying handle can be found in the '610 patent, which disclosure is incorporated herein by reference.

The folding leg apparatus 60 includes an upper pivot rod 68 that is secured to the table leg 50 within the upper rod notches 54. Preferably, the upper pivot rod 68 is welded to the table leg, although other forms of fixation are contemplated. Also preferably, the rod 68 is cylindrical to fit within correspondingly configured notches in the leg. The upper pivot rod 68 is connected at its ends to opposite swivel brackets 70 by way of pivot screws 69. The connection between the upper pivot rod 68 and swivel bracket 70 is such that the rod can rotate relative to the bracket as the bracket itself is pivoted to extend or retract the table leg 50. In accordance with the invention, the swivel bracket 70 is engaged to the upper pivot rod 68 at one end and is connected by way of a pivoting rivet 71 at its opposite end to the mounting flanges 63 of the opposite support brackets 61.

Thus, the swivel bracket 70 is permitted to pivot relative to the support bracket to manipulate the table leg. The swivel bracket 70 preferably includes a bend 70*a* adjacent the pivoting rivet 71 so that the bracket is connected to the upper pivot rod 68 outside the envelope of the support brackets 61.

The folding leg apparatus 60 also includes a lower pivot rod 75 that is engaged to the table leg 50 at the lower rod notches 56. Like the upper pivot rod, the lower pivot rod 75 is preferably cylindrical and welded to the table leg 50. The lower pivot rod 75 is pivotally connected to the support bracket 61 by way of a brace link 78. Specifically, the lower pivot rod 75 is attached to one end of each brace link 78 by way of a pivot screw 76 so that the rod can rotate relative to the brace link. The brace link 78 itself is pivotally fixed to the mounting flanges 63 by way of a pivoting rivet 79, in a manner similar to the swivel bracket 70.

In the specific embodiment, the brace link 78 includes a pair of bends 78*a* and 78*b*, one bend being adjacent the rivet and the other being adjacent the pivot screw. These bends are arranged to orient the connection to the lower pivot rod as close to the upright bars 52 of the table leg 50 as possible. The narrow track of the brace links 78 and the wide track of the swivel brackets 70 help stabilize the table leg 50 when it is in its extended position.

As thus far described, the folding leg apparatus 60 is similar to the folding leg apparatus 10 shown in FIG. 1, which is representative of the device described in U.S. Pat. No. 4,838,180. In particular, the folding leg apparatus 60 retains the upper and lower pivot rods as the means for supporting, folding and unfolding the table leg. In accordance with the present embodiment of the invention, the pivot rods 68 and 75, as well as the swivel brackets 70 and brace links 78, are configured for a table leg, such as leg 50 having dual upright bars. Again, the use of the two pivot rods helps stabilize the upright bars 52 of the table leg 50.

Figure 8:
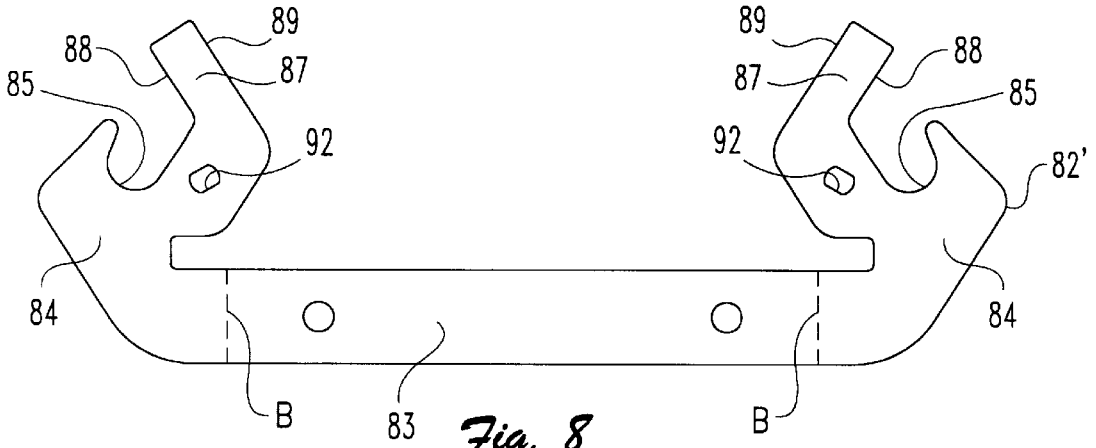
FIG. 8 is a top elevational view of the release lever shown in FIGS. 5–7, with the lever depicted as a stamped blank.

In accordance with the present invention, the folding leg apparatus 60 includes a release lever 82 that is configured differently from the release brackets 40 of the device in the '180 patent. Referring first to FIG. 8, the release lever 82 can be formed from a metal blank 82'. In the preferred embodiment, the overall shape of the release lever is stamped out of a flat sheet of metal to form the release lever blank 82'.

The blank defines an elongated actuator plate 83 that merges at its ends into lever arms 84. Each of the lever arms 84 defines a locking notch 85 that is preferably semicircular in configuration. Specifically, the locking notch 85 is formed to receive the upper pivot rod 68 therein. The lever arms 84 further define a guide foot 87 that forms a guide channel 88 through one edge of the lever arms and opening into the locking notch 85. The guide channel 88 is wide enough to permit free passage of the upper pivot rod 68 into the locking notch 85. Moreover, the guide foot 87 and the lower edge of the guide channel 88 are oriented at an obtuse angle relative to the center of the locking notch 85. This angular orientation of the lower edge of the guide channel 88 provides adequate space for easy removal of the upper pivot rod 68 from within the locking notch 85. The release lever blank 82' is also stamped to form a keyed opening 92 in each of the lever arms 84.

Figure 9:
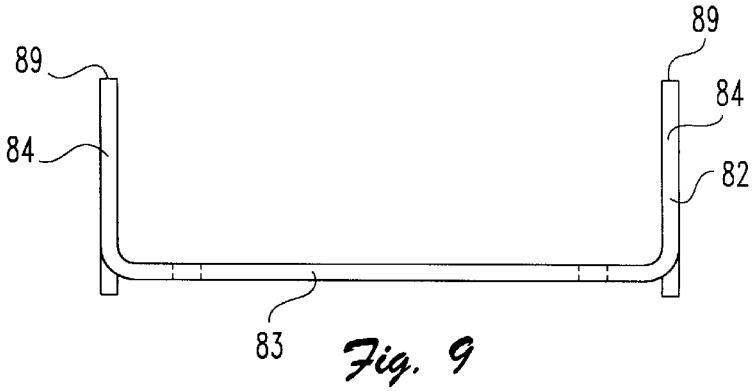
FIG. 9 is a side elevational view of the release lever of FIG. 8 with the stamped blank depth to its operating configuration.

Looking now at FIG. 9, the final form of the release lever 82 is depicted. In particular, the release lever 82 is formed by bending the pre-stamped blank 82' approximately at the bend lines B shown in FIG. 8. The release lever blank 82' is bent so that the lever arms 84 projects substantially perpendicular relative to the actuator plate 83 so that the final form of the release lever 82 is in the form of a "C".

Referring now back to FIG. 5, the operational orientation of the release lever 82 can be seen. In particular, the release lever 82 is arranged so that the actuator plate 83 is disposed between the pivot point for the brace links 78 and the table leg 50. The release lever 82 is pivotally supported on the mounting flanges 63 of each of the support brackets 61 by way of a bolt 90. The bolt 90 is fastened to the release lever 82 by passage of the bolt 90 through the keyed openings 92 in each of the lever arms 84, and is held in place by a nut 91.

Figure 10:
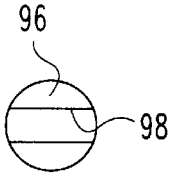
FIG. 10 is an end elevational view of a bolt for the release mechanism depicted in FIGS. 5–7.
Figure 11:
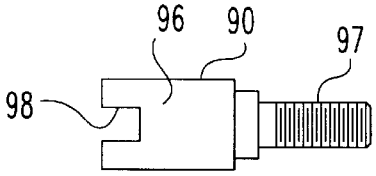
FIG. 11 is a side elevational view of a bolt shown in FIG. 10.
Figure 12:
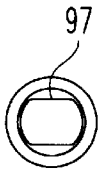
FIG. 12 is an opposite end elevational view of the bolt shown in FIGS. 10 and 11.

Details of the bolt 90 are shown in FIGS. 10–12. The bolt 90 includes a bolt head 96 and a keyed threaded stem 97 projecting therefrom. The stem 97 is keyed to match the keyed opening 92 in each of the lever arms 84. When the bolt 90 is passed through the keyed openings 92, both the release lever 82 and the bolts 90 will rotate as a unit.

Figure 13:
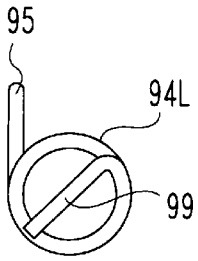
FIG. 13 is an end elevational view of a left-hand torsion spring used in the folding leg apparatus shown in FIGS. 5–7.
Figure 14:
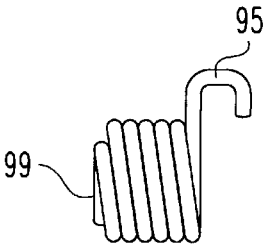
FIG. 14 is a side elevational view of the torsion spring shown in FIG. 13.
Figure 15:
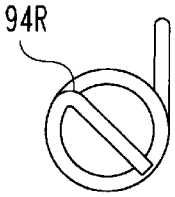
FIG. 15 is an end elevational view of a right hand torsion spring used with the folding leg apparatus shown in FIGS. 5–7.

The head 96 of the bolt 90 also defines an enlarged spring slot 98. In the preferred embodiment, the enlarged slot is arranged to be parallel with the long axis of the keyed stem 97. The slot 98 is configured to engage a portion of a torsion spring 94. In accordance with the invention, the bolt 90 extends through an opening in the mounting flanges 63 of each of the support brackets 61. A torsion spring 94 then passes over the head 96 of the bolt so that the anchor arm 99 of the torsion spring 94 resides within the spring slot 98. The torsion spring 94 also includes a spring anchor 95 that is in the shape of a U so that it can engage the upper edge of each of the mounting flanges 63. Thus, the spring 94 operates to provide torsional resistance against rotation of the bolt 90 relative to the mounting flange 63, which translates ultimately into torsional resistance against rotation of the release lever 92. As depicted in FIGS. 13 and 14, a right handed torsion spring 94, and a left handed torsion spring 94L are provided for engagement to the right and left mounting flanges 63, respectively.

Looking now at FIG. 6, the orientation of the release lever 82 is shown with the table leg 50 in its extended or upright position. In this orientation, it can be seen that the release lever 82 is pivoted so that the upper pivot rod 68 is contained within the locking notch 85 of the lever arm 84. In this position, the guide foot 87 of the release lever 82 is adjacent and generally parallel to the mounting plate 62 of each of the support brackets 61. In this orientation it can be seen that the brace link 78 and swivel bracket 70 are at a predetermined angle so that the table leg 50 projects perpendicularly outward from the tabletop T. In this position, the free end 58 of the each upright bar 52 of the table leg is disposed adjacent to and pointing downward toward the mounting plate 62. The release lever 82 positively locks the upper pivot rod 68 in position so that neither the upper pivot rod 68 nor the swivel bracket 70 can be pivoted out of the position shown in FIG. 6. It is of course understood that in order to fold the leg 50 underneath the tabletop T, it is necessary for both linkages 70 and 78 to be able to pivot about their respective pivoting rivets 71 and 79. The release lever 82 prevents this movement and positively holds the entire release mechanism 80 against disengagement.

In accordance with the preferred embodiment, the free state of the torsion spring 94 is such that the guide foot 87 would rotate to the position 87' shown in phantom in FIG. 6, except that this degree of movement is prevented by the mounting plate 62. Thus, when the release lever 82 is advanced to the locking position shown in FIG. 6, the torsion spring 94 applies a constant torsional pressure to keep the release lever in that position. As a safeguard, the lower edge 89 of the guide foot 87 is arranged so that it is close to the mounting plate 62. In the event that the release lever 82 rotates too far, the foot edge 89 will contact the mounting plate 62 to prevent over rotation of the lever.

It can also be noted that in the locked position of the release lever 82, the actuator plate 83 is readily accessible within the folding leg apparatus 60. Unlike prior designs, the actuator plate 83 is retained in a position of safety, as well as of easy access. Thus, when it is desired to fold the table leg 50 to its stored position, the actuator plate 83 can be easily reached and depressed, as shown in FIG. 7, without risk of pinching the operator's fingers or hand in the release mechanism. As the actuator plate 83 is pushed downward, the release lever 82 operates against the action of the torsion spring 94. AS the release lever 82 continues to pivot about the axis of the pivot bolt 90 the locking notch 85 disengages from the upper pivot rod 68. With continued rotation of the release lever 82 the upper pivot rod 68 becomes aligned with the guide channel 88 so that the upper pivot rod 68 can be moved away from the release lever.

Figure 18:
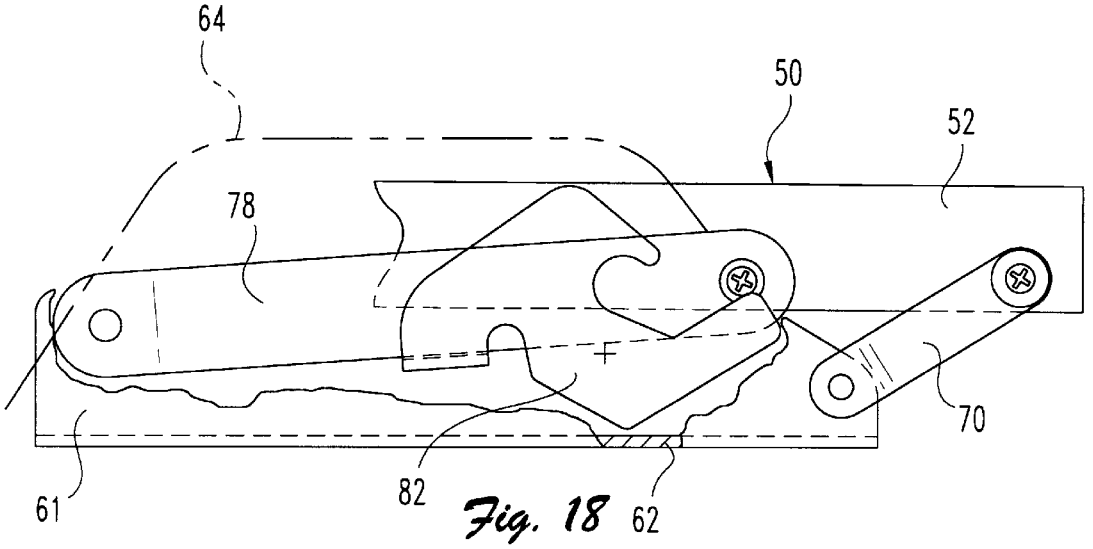
FIG. 18 is side partial cutaway view of certain components of the folding leg apparatus shown in FIGS. 5–7, with the leg in its folded position.

At the position shown in FIG. 7, the table leg 50 can be moved to its stowed position by pushing the foot of the table leg toward the interior of the table. This action causes the free end 58 of the upright bars 52 of the table leg to swing toward the right as viewed in FIG. 7, thereby pivoting the swivel brackets 70 in a clockwise direction. Continued movement of the foot of the table leg 50 toward the interior of the table will cause the swivel brackets 70 to continue to pivot in a clockwise fashion, and to cause the brace link 70 to pivot in a clockwise direction until the link members reach the position shown in FIG. 18. At this orientation, the upright bars 52 of the table leg are generally parallel to the mounting plate 62 of the folding leg apparatus 60. In this position, it can be seen that the table leg 50 is within the envelope defined by the lifting handles 64. Thus, additional tables can be stacked on the folding leg apparatus 60 without contacting the table legs themselves.

Figure 16:
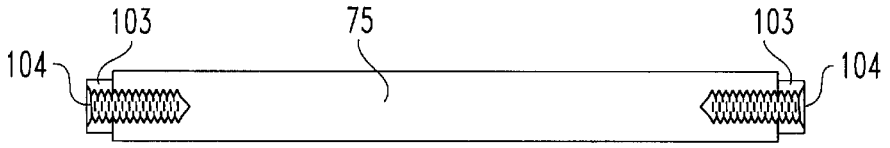
FIG. 16 is a top elevational view of the lower pivot rod used in the folding leg apparatus shown in FIGS. 5–7.
Figure 17:
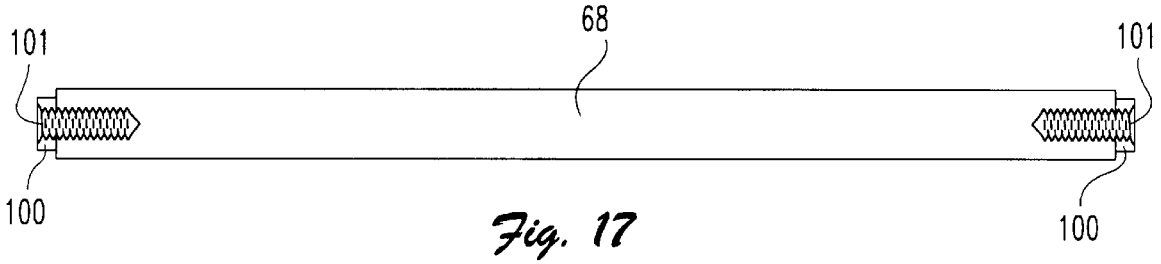
FIG. 17 is a top elevational view of the upper pivot rod used in the folding leg apparatus shown in FIGS. 5–7.

Details of the pivot rods are shown in FIGS. 16 and 17. Looking first at FIG. 16, the lower pivot rod 75 includes a pivot boss 103 and a threaded bore 104 at its opposite ends. The pivot boss 103 is rotatably disposed within openings at the end of the brace links 78 so that the brace links can rotate relative to the lower pivot rod 75. Likewise, looking at FIG. 17, the upper pivot rod 68 includes a pivot boss 100 and a threaded bore 101 at its opposite ends. Again, the pivot boss 100 of the upper pivot rod 68 rotatably fits within an opening at the free end of the swivel brackets 70 so that the brackets can rotate relative to the upper pivot rod 68. The respective pivot screws 76 and 69 engage the corresponding threaded bores 104 and 101 to hold the pivots rods in their position relative to their corresponding linkages, without clamping the rods in that position.

Figure 19:
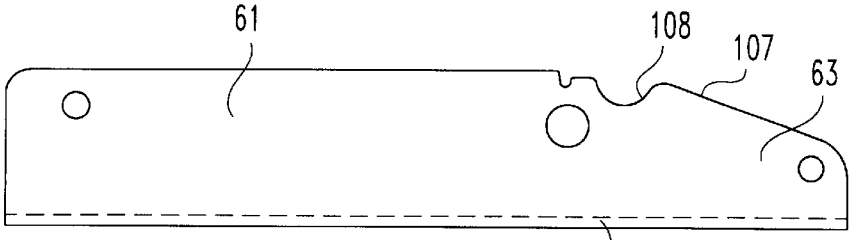
FIG. 19 is a side elevational view of a support bracket usable in the folding leg apparatus and depicting a modification thereof.

The support brackets 61 can also participate in supporting the table leg 50 in its upright position. As shown in FIG. 19, each support bracket 61, and particularly each flange 63, defines a support edge 107. The upper pivot rod 68 can be pressed against this edge 107 by the torsional force applied by the spring 94 to the release lever 82. Alternatively, the support edge 107 can define a recess 108 that receives the upper pivot rod 68. Thus, in some embodiments, the support brackets help restrain the upper pivot rod, which helps prevent accidental dislodgment of the table leg from its upright position.

The folding leg apparatus 60 of the present invention is best suited for dual upright table legs, such as table leg 50. In the specific embodiment, the upright bars 52 forming the table leg 50 are separated by a distance of about 2 inches. However, since the actuator plate 83 of the release lever 82 is a continuous elongated plate, greater distances between the upright bars can be readily accommodated. The release mechanism of the present invention relies upon depressing only one plate, namely actuator plate 83, which provides a decided advantage over the two release brackets of the prior device shown in FIG. 1. Even with greater distances between the dual uprights of the table leg, the plate of the release mechanism need not span the same distance.

In a specific embodiment, the upper and lower rod notches 54 and 56 are separated by a distance of about 2.75 inches. Each of the notches has a diameter that is slightly greater than the outer diameter of the upper and lower pivot rods 68, 75. The outer diameter of the pivot rods is preferably 0.5 inches. The swivel bracket 70 can have a length from the upper pivot rod connection point to the pivoting rivet 71 of about 4.4 inches. The brace links 78 can have an overall length between its pivot point and the connection to the lower pivot rod of about 6.0 inches. Of course, the lengths of the two linkages are determined by the distance between the rod notches 54 and 56, the location of the notches relative to the free end 58 of the table leg, and the orientation of the connection points to the mounting flanges 63 for each of the pivoting rivets.

Preferably, each of the components of the folding leg apparatus 60 is formed of metal and preferably stainless steel. The swivel brackets 70, brace links 78 and the release lever 82 can be stamped from sheet metal stock. The upper and lower pivot rods 68 and 75 are preferably formed from rolled bar stock.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A folding leg apparatus for an article of furniture having a top and at least one leg movable between an extended and a folded position, the leg formed by at least two upright bars disposed apart from each other and having a foot portion attached at the bottom end of the upright bars, with the top end of the upright bars disposed adjacent the top of the article of furniture, the apparatus comprising:

a pair of support brackets having means for mounting said brackets to the top of the article of furniture such that said support brackets straddle the upright bars of the leg, each of said brackets defining an elongated upstanding flange having a first end and an opposite second end;

an upper pivot rod attached to the upright bars adjacent the top end;

a pair of swivel brackets, each pivotably connected at one end thereof to a corresponding end of said upper pivot rod, and pivotably connected at an opposite end thereof to said first end of said flange of a corresponding one of said support brackets;

a lower pivot rod attached to the upright bars distal the top end;

a pair of brace links, each pivotably connected at one end thereof to a corresponding end of said lower pivot rod and pivotably connected at an opposite end thereof to said second end of said flange of a corresponding one of said support brackets; and a latch release mechanism including;

a release lever defined by an elongated actuator plate substantially spanning between said flanges of each of said support brackets and a pair of lever arms disposed at opposite ends of said actuator plate, each of said lever arms defining a locking notch configured to capture said upper pivot rod therein; and means for pivotably mounting said release lever to said flange of each of said support brackets with said actuator plate disposed between said second end of said flange and said means for pivotably mounting, so that said release lever is pivotable between a first position in which said locking notch captures said upper pivot rod and a second position in which said locking notch is separated from said upper pivot rod, said means including a torsion spring operatively anchored to said flange to bias said release lever to said first position, said release lever movable to said second position by depressing said actuator plate, whereby each of said swivel brackets is prevented from rotating about said opposite end thereof when said upper pivot rod is captured within said locking notches of said release lever, to thereby prevent movement of the upright bars of the leg from the extended position, and whereby each of said swivel brackets is permitted to rotate about said opposite end when said upper pivot rod is released from said locking notches to thereby permit movement of the upright bars of the leg to the folded position.

2. The folding leg apparatus according to claim 1, wherein said lever arms of said release lever define a guide channel opening to said locking notch, said guide channel positioned to guide said upper pivot rod out of said locking notch when said release lever is pivoted to said second position.

3. The folding leg apparatus according to claim 1, wherein said lever arms of said release lever define a foot portion opposite said locking notch, said foot portion having a foot edge that contacts a corresponding one of said support brackets when said release lever pivots in the direction from said first position to said second position.

4. The folding leg apparatus according to claim 1, wherein said upper pivot rod and said lower pivot rod are rigidly attached to the upright bars of the table leg.

5. The folding leg apparatus according to claim 1, wherein:

each of said lever arms defines a keyed opening therethrough;

said flange of each of said support brackets defines an opening therethrough; and said means for pivotably mounting includes a bolt configured to extend through said opening in said flange and having a keyed stem configured to extend through said keyed opening so that said lever arm rotates with said bolt.

6. The folding leg apparatus according to claim 5, wherein:

said bolt includes an enlarged head to prevent passage through said opening in said flange, said head defining a spring slot therein; and said torsion spring is configured to receive said head of said bolt therethrough and includes an anchor arm configured to be retained within said spring slot, so that said torsion spring operates on said bolt to bias said release lever to said second position.

7. The folding leg apparatus according to claim 1, wherein said flange of each of said support brackets defines a recess configured to receive said upper pivot rod when said upper pivot rod is captured within said locking notch of said release lever.

8. A folding leg apparatus for an article of furniture having a top and at least one leg movable between an extended and a folded position, the leg having a foot portion attached at the bottom end and the top end disposed adjacent the top of the article of furniture, the apparatus comprising:

a pair of support brackets having means for mounting said brackets to the top of the article of furniture such that said support brackets straddle the leg, each of said brackets defining an elongated upstanding flange having a first end and an opposite second end;

an upper pivot rod attached to the leg adjacent the top end;

a pair of swivel brackets, each pivotably connected at one end thereof to a corresponding end of said upper pivot rod, and pivotably connected at an opposite end thereof to said first end of said flange of a corresponding one of said support brackets;

a lower pivot rod attached to the leg distal the top end;

a pair of brace links, each pivotably connected at one end thereof to a corresponding end of said lower pivot rod and pivotably connected at an opposite end thereof to said second end of said flange of a corresponding one of said support brackets; and a latch release mechanism including;

a release lever defined by an elongated actuator plate substantially spanning between said flanges of each of said support brackets and a pair of lever arms disposed at opposite ends of said actuator plate, each of said lever arms defining a locking notch configured to capture said upper pivot rod therein; and means for pivotably mounting said release lever to said flange of each of said support brackets with said actuator plate disposed between said second end of said flange and said means for pivotably mounting, said means including a torsion spring operatively anchored to said flange to bias said release lever to said first position in which said locking notch captures said upper pivot rod, said release lever movable to a second position to release said upper pivot rod from said locking notch by depressing said actuator plate.

9. The folding leg apparatus according to claim 8, wherein said lever arms of said release lever define a guide channel opening to said locking notch, said guide channel positioned to guide said upper pivot rod out of said locking notch when said release lever is pivoted to said second position.

10. The folding leg apparatus according to claim 8, wherein said lever arms of said release lever define a foot portion opposite said locking notch, said foot portion having a foot edge that contacts a corresponding one of said support brackets when said release lever pivots in the direction from said first position to said second position.

11. The folding leg apparatus according to claim 8, wherein said upper pivot rod and said lower pivot rod are rigidly attached to the table leg.

12. The folding leg apparatus according to claim 8, wherein:

each of said lever arms defines a keyed opening therethrough;

said flange of each of said support brackets defines an opening therethrough; and said means for pivotably mounting includes a bolt configured to extend through said opening in said flange and having a keyed stem configured to extend through said keyed opening so that said lever arm rotates with said bolt.

13. The folding leg apparatus according to claim 12, wherein:

said bolt includes an enlarged head to prevent passage through said opening in said flange, said head defining a spring slot therein; and said torsion spring is configured to receive said head of said bolt therethrough and includes an anchor arm configured to be retained within said spring slot, so that said torsion spring operates on said bolt to bias said release lever to said second position.

14. The folding leg apparatus according to claim 8, wherein said flange of each of said support brackets defines a recess configured to receive said upper pivot rod when said upper pivot rod is captured within said locking notch of said release lever.

15. A folding leg apparatus for a table having a tabletop comprising:

a leg having a foot at one end for contacting the floor for supporting the table and an opposite free end;

a pair of support brackets mountable to the underside of the tabletop and straddling said leg;

linkage means connected between the leg and each of said pair of support brackets for permitting movement of the table leg from an upright position in which the leg extends from the tabletop and a stowed position in which the leg is adjacent the underside of the tabletop, said linkage means including a pivot bar attached to said leg adjacent said opposite free end; and a latch mechanism including;

a release lever having an elongated actuator plate spanning substantially between said support brackets and including a pair of lever arms integral with said actuator plate, said lever arms defining a locking notch configured to capture said pivot rod therein;

means for pivotably mounting said release lever to said support brackets including a torsion spring operatively anchored to said at least one support bracket to bias said release lever to a first position in which said locking notch captures said pivot rod, and rotatable by depressing said actuator plate to a second position in which said pivot rod is releasable from said locking notch.

* * * * *

UNITED STATES PATENT AND TRADEMARK OFFICE

CERTIFICATE OF CORRECTION

PATENT NO. : 5,913,272

DATED : June 22, 1999

INVENTOR(S) : David R. Gutgsell; Scott Schwinghammer

It is certified that error appears in the above-identified patent and that said Letters Patent is hereby corrected as shown below:

Col. 1, line 18
replace "weagle"
with --Weagle--
Col. 1, line 24
replace "weagle"
with --Weagle--
Col. 7, line 9
replace "94"
with --$94_R$--
Col. 7, line 56
replace "AS"
with --As--

Signed and Sealed this

Twenty-first Day of December, 1999

*Attest:*

Q. TODD DICKINSON

*Attesting Officer*

*Acting Commissioner of Patents and Trademarks*